US007004786B1

(12) United States Patent
Bloom et al.

(10) Patent No.: US 7,004,786 B1
(45) Date of Patent: Feb. 28, 2006

(54) CORD MANAGEMENT DEVICE

(75) Inventors: Sam A. Bloom, Dallas, TX (US); Christian O. Gerard, Austin, TX (US); Philip Leveridge, Austin, TX (US)

(73) Assignee: Bloomin Partners, Inc., Dallas, TX (US)

( * ) Notice: Subject to any disclaimer, the term of this patent is extended or adjusted under 35 U.S.C. 154(b) by 0 days.

(21) Appl. No.: 11/009,811

(22) Filed: Dec. 10, 2004

Related U.S. Application Data

(63) Continuation of application No. 10/937,463, filed on Sep. 8, 2004.

(51) Int. Cl.
*H01R 13/72* (2006.01)

(52) U.S. Cl. ..... 439/501; 439/535; 439/488; 439/490; 439/142

(58) Field of Classification Search ..... 439/501, 439/652, 535, 488–491, 142; 174/53, 135
See application file for complete search history.

(56) References Cited

U.S. PATENT DOCUMENTS 4,206,957 A * 6/1980 Ludwig et al. ..... 439/142
6,017,228 A * 1/2000 Verbeek et al. ..... 439/142
6,220,897 B1 * 4/2001 Maxwell ..... 439/652
6,352,447 B1 * 3/2002 Ruth ..... 439/540.1
6,415,672 B1 * 7/2002 Hamilton et al. ..... 73/866.3
6,619,980 B1 * 9/2003 Hsiao ..... 439/501
6,658,773 B1 * 12/2003 Rohne et al. ..... 40/542
6,722,917 B1 * 4/2004 Huang ..... 439/501
6,793,523 B1 * 9/2004 Wei ..... 439/501
6,805,581 B1 * 10/2004 Love ..... 439/535
6,811,281 B1 * 11/2004 Hsiao ..... 362/226
6,844,494 B1 * 1/2005 Nevins ..... 174/53
6,875,051 B1 * 4/2005 Pizak ..... 439/535

* cited by examiner

*Primary Examiner*—Gary Paumen

(74) *Attorney, Agent, or Firm*—Baker Botts L.L.P.

(57) ABSTRACT

A device for providing electricity includes a frame, an outlet, a plug, and a cavity cover. The outlet is capable of providing electricity to devices plugged into the outlet. The plug is operable to provide electricity to the outlet from an external power source. The frame forms a cavity that is capable of storing a cord. Additionally, the cavity cover is capable of allowing access to the cavity through a cavity opening when a force is applied to the cavity cover and covering the cavity opening when the force is removed from the cavity cover.

41 Claims, 7 Drawing Sheets

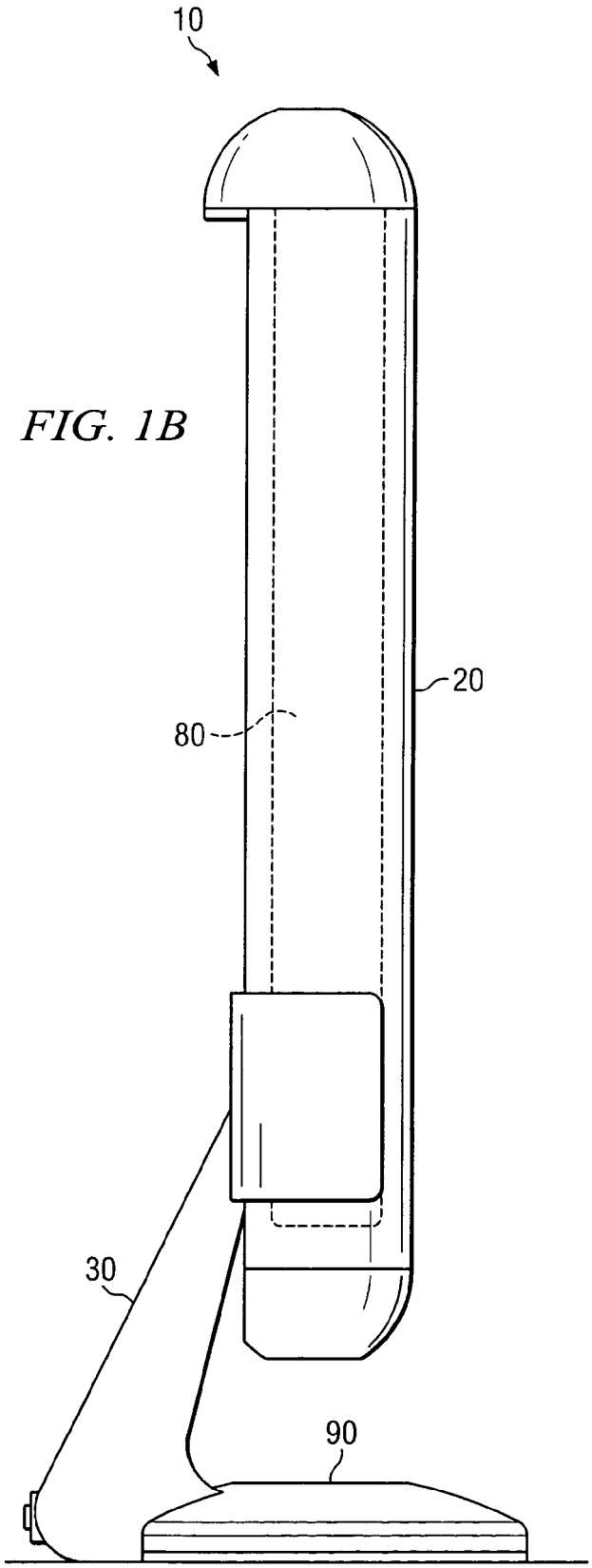
FIG. 1B
FIG. 2A
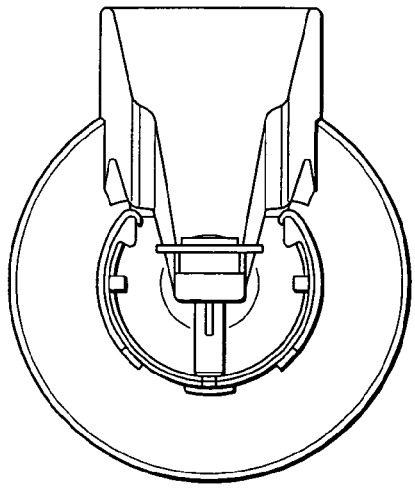
FIG. 2B
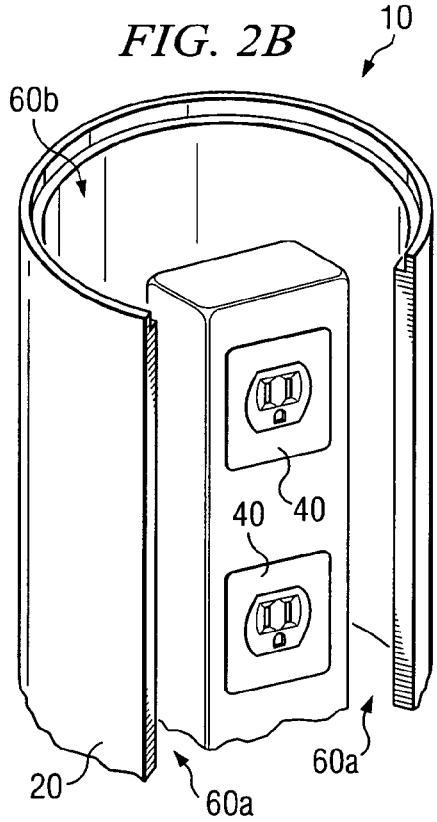

CORD MANAGEMENT DEVICE

CROSS REFERENCE TO RELATED APPLICATION

This application is a continuation of pending U.S. patent application Ser. No. 10/937,463, filed Sep. 8, 2004 and entitled "Cord Management Device."

TECHNICAL FIELD OF THE INVENTION

This invention relates in general to consumer electronic devices, and more particularly, to a cord management system for electronic devices.

BACKGROUND OF THE INVENTION

In recent years, rapid growth in the number of electronic devices available in the consumer market, increased automation of the industrial sector, and the emergence of electronic information processing and storage in many areas of the business world has introduced a multitude of new electronic devices to the home and workplace. This in turn has led to a growing reliance on systems that utilize or include multiple electronic components. As the number of components in a given system increases, the power cords and other cords associated with the various components can produce difficulties for a user attempting to locate and free the cord associated with a particular component, cause hazardous home or workplace conditions, and create an eyesore. Thus, a system capable of effectively managing power cords of one or more electronic components could simplify use of the electronic components, reduce safety concerns associated with the power cords, and provide aesthetic benefits.

SUMMARY OF THE INVENTION

In accordance with the present invention, the disadvantages and problems associated with supplying power and various forms of electronic signals to electronic devices have been substantially reduced or eliminated. In particular, a cord management device is provided.

In accordance with one embodiment of the present invention, a device for providing electricity includes a frame, an outlet, a plug, and a cavity cover. The outlet is capable of providing electricity to devices plugged into the outlet. The plug is operable to provide electricity to the outlet from an external power source. The frame forms a cavity that is capable of storing a cord. Additionally, the cavity cover is capable of allowing access to the cavity through a cavity opening when a force is applied to the cavity cover and covering the cavity opening when the force is removed from the cavity cover.

In accordance with another embodiment of the present invention, an apparatus for managing cords includes a cavity, a cavity opening, and a cavity cover. The cavity is capable of storing a cord. The cavity opening provides access to the cavity. The cavity cover is capable of allowing access to the cavity through the cavity opening when a force is applied to the cavity cover and covering the cavity opening when the force is removed from the cavity cover.

Important technical advantages of certain embodiments of the present invention include improving home and workplace safety, providing a surge-protector with improved aesthetic qualities, and offering an effective system for notifying users of the current status of surge-protection features. Other technical advantages of the present invention will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which:

FIGS. 1A–1B illustrate a front and side view of a cord management device according to a particular embodiment of the present invention;

FIGS. 2A–2D illustrate in greater detail the cord management device and cavity covers of the cord management device.

DETAILED DESCRIPTION OF THE INVENTION

Figure 1A:
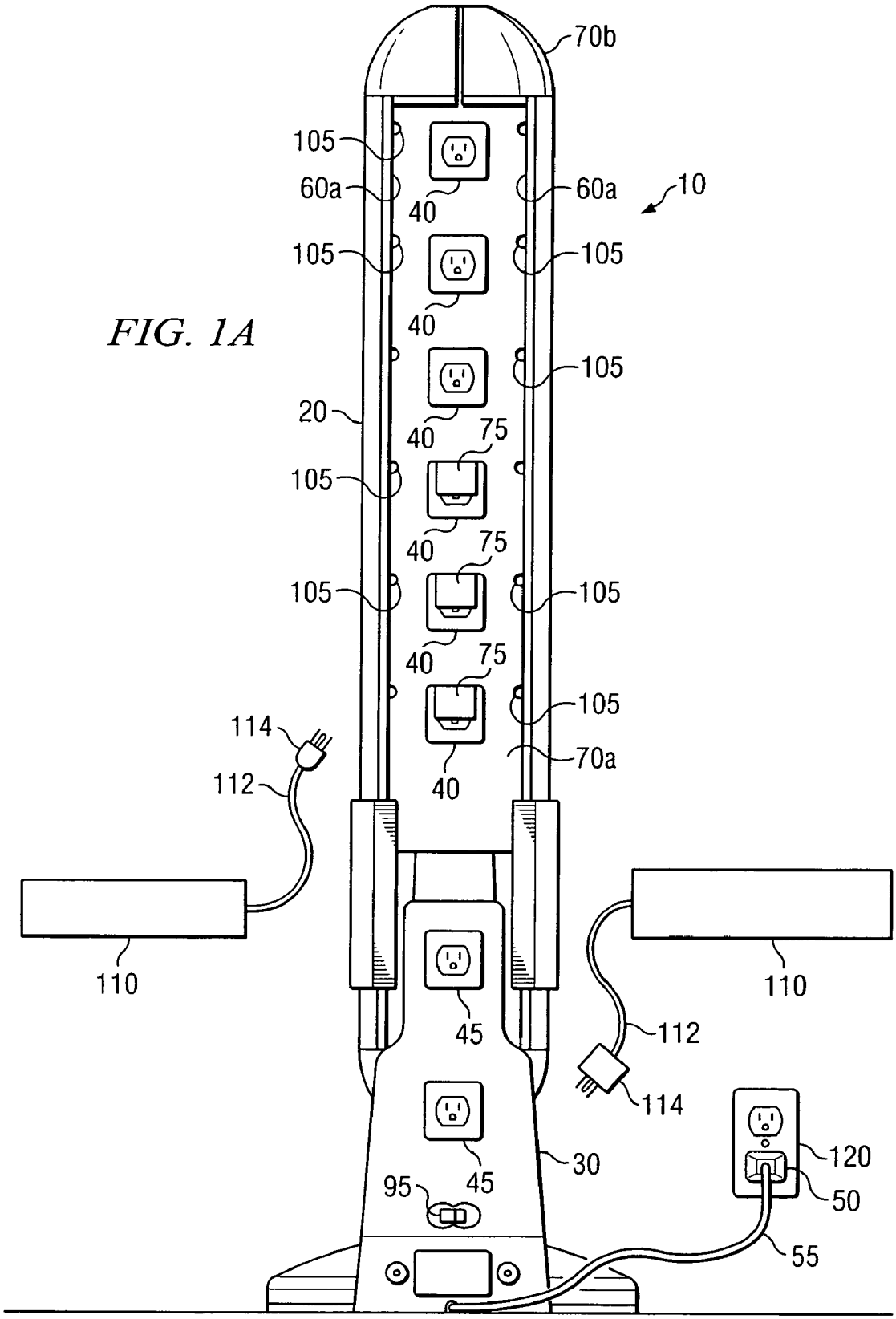

FIGS. 1A–1B illustrate, from numerous perspectives, a cord management device 10 according to a particular embodiment. FIGS. 1A and 1B provide a front and a side view, respectively, of cord management device 10. In the illustrated embodiment, cord management device 10 includes frame 20, base 30, a plurality of outlets 40, one or more brick outlets 45, a plug 50, one or more cavity openings 60, one or more cavity covers 70, safety tabs 75, a status indicator 90, and a switch 95. FIG. 1A additionally shows electronic devices 110 and external power supply 120. Cord management device 10 provides electricity from external power supply 120 to electronic devices 110 plugged into outlets 40. Additionally, cord management device 10 is capable of storing cords associated with electronic devices 110 plugged into outlets 40 within a cavity 80 of cord management device 10, represented by a dotted-line outline in FIG. 1B.

Frame 20 holds outlets 40 and other components of cord management device 10. In particular embodiments of cord management device 10, frame 20 encloses cavity 80 for storing one or more device cords 112 within frame 20. Frame 20 may include one or more components and be composed of plastic, rubber, aluminum, or any other suitable material. As illustrated in FIG. 1A, a portion of frame 20 represents a substantially cylindrical structure with a hollow interior. FIG. 3 illustrates, in greater detail, the inside of frame 20 according to a particular embodiment of cord management device 10.

Base 30 supports frame 20 and other components of cord management device 10 and, in a particular embodiment, is capable of holding frame 20 in a vertical position. More specifically, base 30 may be capable of supporting frame 20 so that a lengthwise dimension of frame 20 extends in a vertical direction away from base 30. Base 30 may include one or more weighted components to provide additional weight to base 30 and, thus, increase the stability of cord management device 10 when cord management device 10 is placed in an upright position.

Outlets 40 and brick outlets 45 provide electricity to electronic devices 110 plugged into outlets 40. Brick outlets 45 are configured, spaced, and/or sized to accept larger device plugs 114 than outlets 40. In a particular embodiment, each of outlets 40 and brick outlets 45 may represent a conventional outlet capable of accepting a two-wire or three-wire device plug 114 and providing 120-volt alternating current (AC) electricity to a device coupled to the device plug 114. Additionally, one or more of outlets 40 and brick outlets 45 may be surge-protected and capable of preventing the peak AC-voltage supplied by those outlets 40 and brick outlets 45 from exceeding a predetermined safe level. The power supplied to outlets 40 and brick outlets 45 may be controlled by switch 95. More specifically, power may be supplied to outlets 40 and brick outlets 45 when switch 95 is in an "ON" position and power may be withheld when switch 95 is in an "OFF" position. In a particular embodiment, outlets 40 and brick outlets 45 may represent identical components with the only difference being the amount of space allotted to a particular outlet 40 or brick outlet 45.

Plug 50 allows cord management device 10 to couple to an external power supply, such as a wall outlet, to provide electricity to outlets 40 and brick outlets 45. Cord management device 10 may include a primary cord 55 that couples plug 50 to outlets 40, brick outlets 45, and other components of cord management device 10, allowing those components to be connected to external power supply 120 which may be physically removed from cord management device 10. Plug 50 may represent any appropriate component for coupling components of cord management device 10 to external power supply 120. For example, in a particular embodiment, plug 50 represents a conventional three-pronged plug suitable for plugging into a grounded 120-volt outlet.

Cavity openings 60 represent apertures, slits, holes, or other forms of openings in frame 20 suitable to provide access to cavity 80 within frame 20. In particular embodiments of cord management device 10, cavity openings 60 may be shaped, sized, and positioned to allow the device cords 112 plugged into cord management device 10 to be stored within frame 20. Thus, cavity openings 60 may represent openings of any size or shape and may be placed on frame 20 in any suitable location, based on the configuration and anticipated use of cord management device 10. Moreover, cord management device 10 may include any appropriate number of cavity openings 60. In a particular embodiment, cord management device 10 may include a single cavity opening 60 configured to allow excess lengths of a particular device cord 112 to be deposited inside frame 20 with both ends of that device cord 112 extending from cavity 80 through the single cavity opening 60. An example of such an embodiment is described below with respect to FIGS. 6A and 6B.

In an alternative embodiment, cord management device 10 may include multiple cavity openings 60 configured to allow excess lengths of a particular device cord 112 to be deposited within frame 20 with a first end of that component cord extending from cavity 80 through a first cavity opening 60 and a second end of that component cord extending from cavity 80 through a second cavity opening 60.

In the illustrated embodiment, frame 20 comprises three cavity openings 60, including two lateral openings 60*a* and a top opening 60*b*. Lateral openings 60*a* represent space between outlets 40 and a portion of frame 20 running along a side face of frame 20. Top opening 60*b* represents a circular opening in a top surface of the cylindrical frame 20. As described in greater detail below, top opening 60*b* and lateral openings 60*a* are positioned so that a continuous length of cord may be deposited within the interior of frame 20 with one end extending out of cavity 80 through top opening 60*b* and the other end extending out of cavity 80 through either lateral opening 70*a*.

Cavity covers 70 cover cavity openings 60 and facilitate access to the interior of frame 20. Each cavity cover 70 covers a portion or all of a particular cavity opening 60. Cavity covers 70 may represent any suitable element capable of both allowing access to the interior of frame 20 and covering cavity openings 60. As a result, cavity covers 70 may be capable of bending, sliding, swinging, or otherwise moving, rotating, opening, and/or assuming another position so that a user of cord management device 10 may insert or retrieve device cords 112 from the interior of cord management device 10. In general, cavity cover 70 may be capable of moving or changing position in any appropriate manner to facilitate access. Furthermore, in a particular embodiment, cavity covers 70 may be configured to automatically return to an original location or position once the device cord has been inserted in or retrieved from the interior of cord management device 10. For example, in a particular embodiment, cavity covers 70 are composed of an elastomeric material capable of bending when a force is applied to the cavity cover 70 and then returning to an original shape once the force is removed.

Figure 2C:
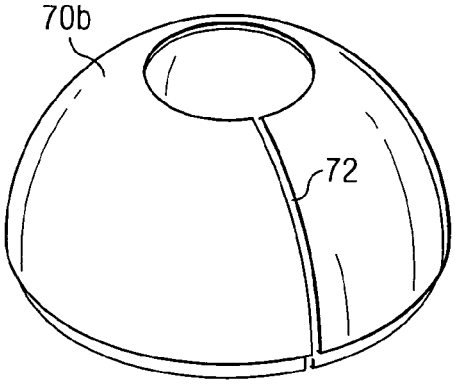
Figure 2D:
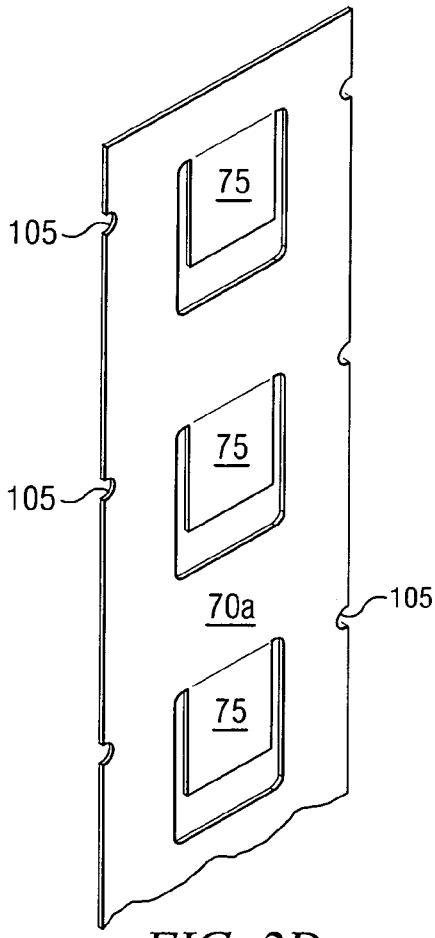

In the illustrated embodiment, cavity covers 70 are represented by lateral cover 70*a* and slitted cap 70*b*. Lateral cover 70*a* is attached to frame 20 and runs the length of lateral openings 60*a*. FIGS. 2C and 2D shows particular embodiments of slitted cap 70*b* and lateral cover 70*a* removed from cord management device 10. Slitted cap 70*b* sits on top of top opening 60*b* and allows access to top opening 60*b* through slit 72. Operation of cavity covers 70, in such an embodiment, is discussed in greater detail below in connection with FIGS. 3A–3D.

Switch 95 controls a flow of electricity to outlets 40 and brick outlets 45. When switch 95 is in a first position, electricity flows from external power supply 120 to outlets 40 and brick outlets 45 and to electronic devices 110 plugged into outlets 40 and brick outlets 45. When switch 95 is in a second position, the flow of electricity to outlets 40 and brick outlets 45 is disrupted and electronic devices 110 do not receive electricity. Switch 95 may represent a conventional electric switch.

Status indicator 90 indicates a current state of cord management device 10. Status indicator 90 may provide information about any appropriate state of cord management device 10. For example, in a particular embodiment, of cord management device 10 status indicator 90 provides information about the status of electricity flow to outlets 40 and brick outlets 45. In such an embodiment, status indicator 90 may indicate, at appropriate times, "PROTECTED", "FAULT", and "OFF" states, as described in greater detail below.

Additionally, status indicator 90 may include any appropriate components to provide information about the relevant state of cord management device 10. For example, status indicator may include light bulbs, light-emitting diodes (LEDs), a liquid crystal diode (LCD) display, sound generating components, or any other appropriate components for conveying information. In a particular embodiment, status indicator 90 includes one or more lighting elements and descriptive text printed over a background of luminescent paint. During operation, the lighting elements illuminate particular words or symbols in the text causing that text to glow, which in turn enhances the visibility of the text. The portions of the text that are glowing provide information about the current state of cord management device 10. Operation of such an embodiment is described in conjunction with FIGS. 5A–5E below.

Nightlight 100 provides a dim, low-range light that illuminates portions of cord management device 10 and/or the area surrounding cord management device 10. Nightlight 100 may enable a user of cord management device 10 to see outlets 40 and brick outlets 45, status indicator 90, switch 95, or other components of cord management device 10 in an otherwise dark area. In a particular embodiment, nightlight 100 may represent all or certain components of status indicator 90, switch 95, or any other suitable component of cord management device 10. In the illustrated embodiment, nightlight 100 represents luminescent paint and other components of status indicator 90 that provide illumination while cord management device 10 is operating with a particular status.

Safety tabs 75 represent passive elements that cover any or all of plugs 40 and brick plugs 45. Safety tabs 75 may represent any appropriate components that are capable of covering plugs 40 or brick plugs 45 without the need for human intervention. For example, in a particular embodiment, each safety tab 75 represents an elastomeric tabs that covers a particular outlet 40 when no device plug 114 is plugged into that outlet 40. In such an embodiment, the user may bend safety tab 75 to allow the user to insert device plug 114 into the associated outlet 40. When the user subsequently removes device plug 114, the elastomeric properties of safety tab 75 cause safety tab 75 to bend back to the original position of safety tab 75, once again covering that outlet 40. As a result, safety tabs 75 may prevent children, pets, or other individuals from shocking themselves on covered outlets 40 without a conscious effort on the part of the user to keep outlets 40 covered. Thus, safety tabs 75 may provide safety benefits in particular embodiments of cord management device 10. Although safety tabs 75 are shown, for the purposes of illustration on only select outlets 40, a particular embodiment of cord management device 10 may include safety tabs 75 covering any, all, or none of outlets 40 and/or brick outlets 45.

Notches 105 secure device cords 112 and limit the movement of device cords 112 after component cords have been plugged into cord management device 10. Depending on the configuration of cord management device 10, notches 105 may represent apertures in frame 20 and/or cavity covers 70. In a particular embodiment, notches 105 are located on either side of each outlet 40 and allow device cords 112 to be secured to frame 20 or other components of cord management device 10 near the particular outlet 40 into which that device cord 112 is plugged. Placement of notches in this manner may limit the amount of excess device cord 112 extending from cavity 80 and prevent device cords 112 from straying from cord management device 10 or getting tangled with one another. Additionally, notches 105 may allow a particular cavity cover 70 to close completely despite the fact that a device cord 112 may be extending from cavity 80 through the associated cavity opening 60.

Electronic devices 110 represent any appropriate electronic component, device, or apparatus suitable, based on the configuration and characteristics of cord management device 10, for receiving electricity from cord management device 10. Electronic devices 110 couple to cord management device 10 through device cords 112 and device plugs 114.

In operation, a user plugs device plugs 114 of one or more electronic devices 110 in outlets 40 or brick outlets 45. More specifically, device plugs 114*a* are plugged into outlets 40 and device plugs 114*b* are plugged into brick outlets 45. As noted above, brick outlets 45 are sized, spaced, or otherwise configured to accept component plugs with larger casings, such as component plugs containing transformers and, as a result, device plugs 114 plugged into brick outlets 45 are heavier than device plugs 114 plugged into outlets 40. In particular embodiments, outlets 40 and brick outlets 45 are positioned so that most, or substantially all, of brick outlets 45 are positioned below outlets 40 when cord management device 10 is operating. Thus, as a result of brick outlets 45 being located lower on cord management device 10 than outlets 40, the center of gravity of cord management device 10 is lower than if brick outlets 45 and outlets 40 were located in arbitrarily selected positions on cord management device 10. Consequently, such an embodiment of cord management device 10 may provide added stability to prevent cord management device 10 from tipping over.

Once device plugs 114 are plugged into outlets 40 and brick outlets 45, or at any other appropriate time, the user may deposit device cords 112 within the interior of frame 20 through cavity openings 60. The interior of frame 20 is described in greater detail in conjunction with FIG. 3. By providing a storage space for device cords 112, particular embodiments of cord management device 10 offer organizational, safety, and aesthetic benefits.

Additionally, cavity covers 70 cover cavity openings 60 and hide device cords 112 stored in cavity 80 from view. Thus, cavity covers 70 may provide additional aesthetic benefits for cord management device 10. Furthermore, cavity covers 70 may improve the effectiveness of cord management device 10 by ensuring device cords 112 do not stray from cavity 80 if electronic devices 110 or cord management device 10 are moved, or device cords 112 are otherwise rearranged.

Once device plugs 114 are plugged into outlets 40 and brick outlets 45, or at any other appropriate time, the user may control flow of electricity to outlets 40 and brick outlets 45 and, as a result, to electronic devices 110 by toggling switch 95. Additionally, status indicator 90 provides an indication of the state of cord management device 10. In a particular embodiment, the state of cord management device 10 that is described by status indicator 90 may relate to the flow of electricity from external power supply 120 to outlets 40 and brick outlets 45.

For example, electricity may flow to outlets 40 and brick outlets 45 from external power supply 120 when cord management device 10 is in an "PROTECTED" state as discussed above. Conversely, the flow of electricity may be disrupted when cord management device 10 is in an "OFF" state. Additionally, in an embodiment providing surge protection, surge protection components may be destroyed or damaged by a sufficiently large surge in voltage supplied by external power supply 120. Thus, in particular embodiments, a "FAULT" state may result in cord management device 10 following a large voltage surge. While cord management device 10 is in the "FAULT" state, cord management device 10 may be configured to terminate the flow of electricity to outlets 40 and brick outlets 45 regardless of whether switch 95 is in the "ON" position. In such an embodiment, status indicator 90 may include appropriate components configured to indicate the "PROTECTED", "OFF", and "FAULT" states to the user. FIGS. 5A–5E illustrate operation of a particular embodiment of status indicator 90 in greater detail.

FIGS. 2A and 2B illustrate a top and front view of a particular embodiment of cord management device 10 with lateral cover 70*a* and slitted cap 70*b* removed. FIGS. 2C and 2D illustrate a particular embodiment of slitted cap 70*b* and lateral cover 70*a*, respectively, removed from cord management device 10. As illustrated lateral cover 70*a* and safety tabs 75 represent a single piece of molded elastomeric material. In alternative embodiments, however, lateral cover 70*a* and safety tabs 75 may represent physically discrete components.

FIGS. 3A–3D illustrate a particular embodiment of cord management device 10 as a device cord 112 is stored in cavity 80. More specifically, FIGS. 3A–3D illustrate an embodiment of cord management device 10 that includes a slitted cap 70*b* and lateral cover 70*a* as cavity covers 70.

Figure 3A:
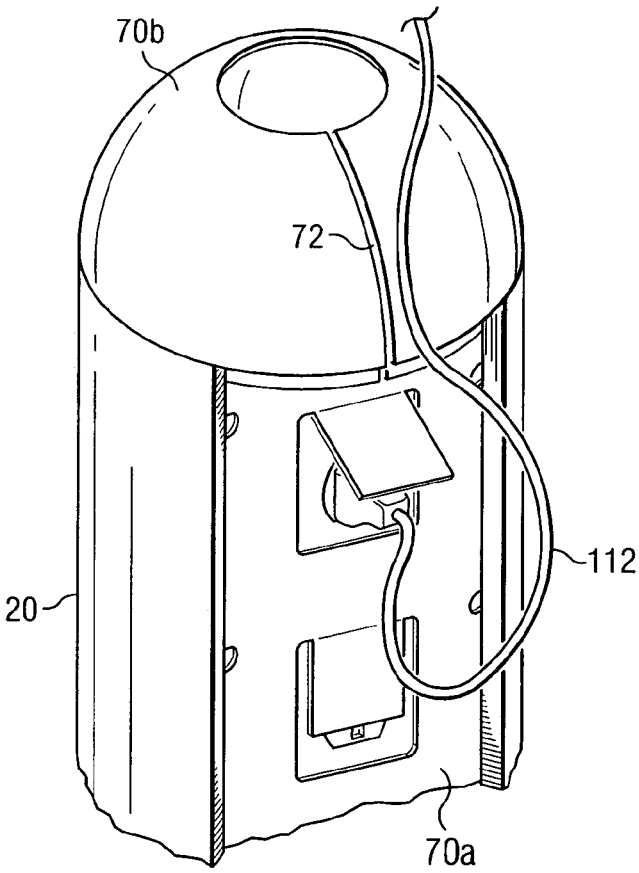
FIGS. 3A–3D illustrate operation of cavity covers of the cord management device according to particular embodiment.
Figure 3B:
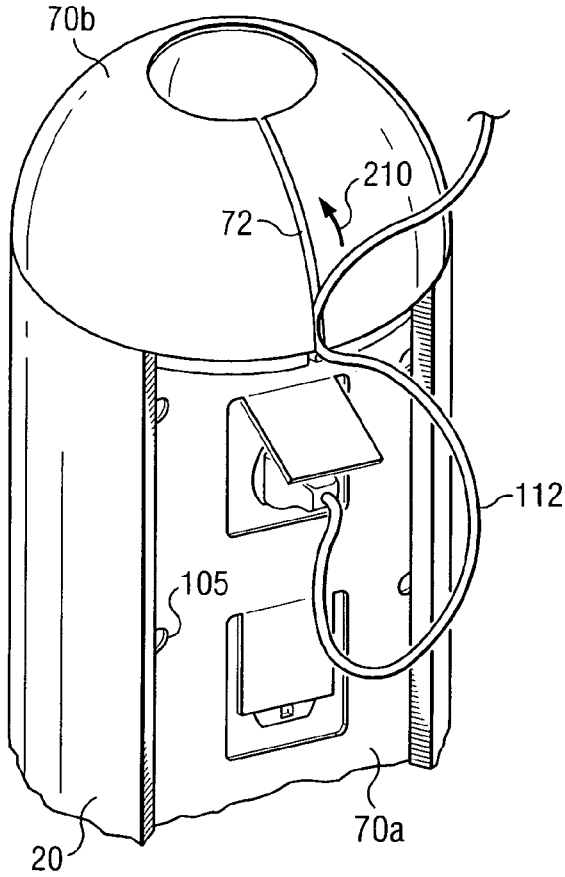

FIG. 3A illustrates an upper portion of cord management device 10 as a user positions device cord 112 near slitted cap 70*b* and aligns device cord 112 with slit 72. As shown in FIG. 3B, the user then applies force 210 to slitted cap 70*b* by pressing device cord 112 into slit 72 or pulling device cord 112 across slit 72. In response to force 210, slit 72 opens providing device cord 112 with access to top cavity opening 60. The user slides device cord 112 through slit 72. As force 210 is removed, slit 72 closes behind device cord 112.

Figure 3C:
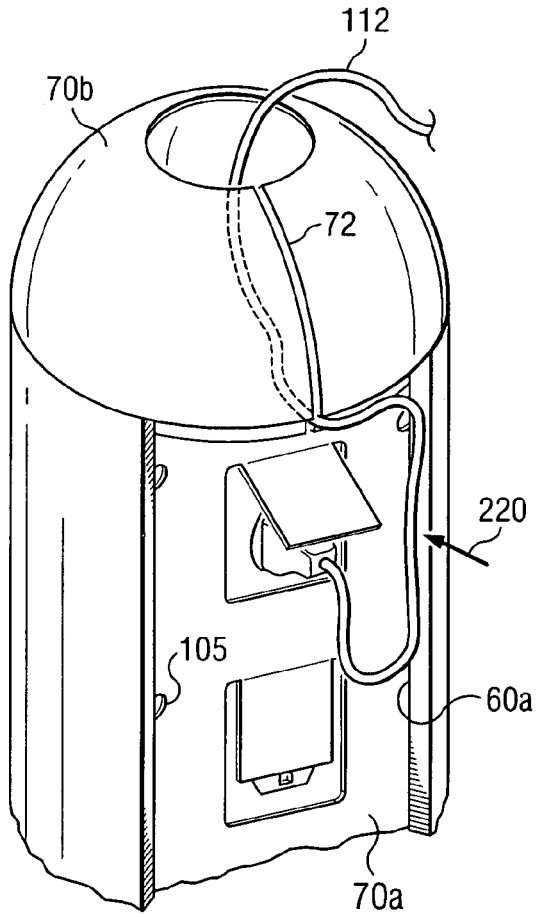

FIG. 3C illustrates cord management device 10 as user aligns device cord 112 with a seam between lateral cover 70*a* and frame 20. After aligning device cord 112 with the seam, the user applies a force 220 to lateral cover 70*a*, for example, by pressing on device cord 112. Lateral cover 70*a* bends in response to force 220 providing entry to cavity 80 for device cord 112. After device cord 112 has been deposited in cavity 80, lateral cover 70*a* returns to the original position of lateral cover 70*a*.

Figure 3D:
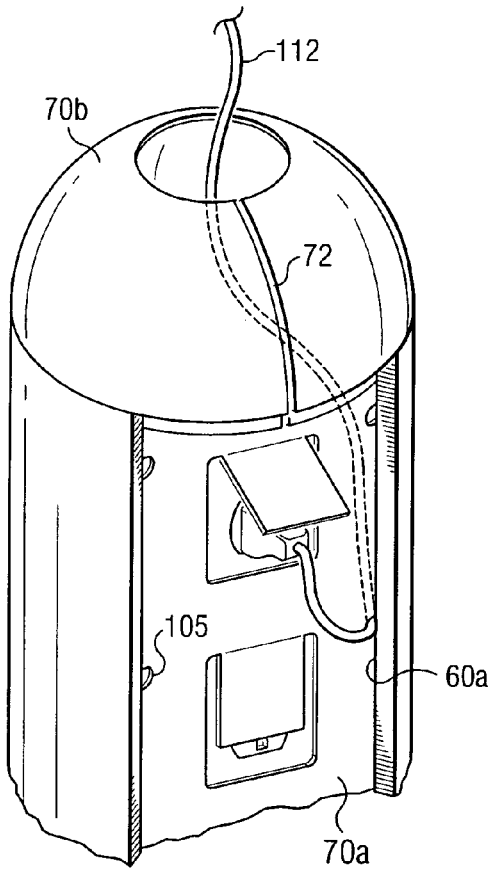

FIG. 3D illustrates cord management device 10 after device cord 112 has been deposited and lateral cover 70*a* has returned to the original position of lateral cover 70*a*. While stored in cavity 80, in the illustrated embodiment, one end of device cord 112 extends from cavity 80 through lateral opening 60*a* while the other end of device cord 112 exits cavity 80 through top opening 60*b*.

Additionally, particular embodiments of cord management device 10 may include a recess 220 between the lip of slitted cap 70*b* and the top edge of frame 20, as outlined by the dotted line in FIG. 3B that provides additional benefits by allowing the user to insert device cord 112 into cavity 80 without removing slitted cap 70*b*. More specifically, in such an embodiment, the user can plug a particular device cord 112 into an outlet 40. Then, while that device cord 112 is plugged into outlet 40, the user can deposit device cord 112 into cavity 80 by pressing device cord 112 through slit 72 and then through lateral cover 70*a*, all without removing slitted cap 70*b*. Thus, particular embodiments of cord management device 10 may provide significant ease-of-use benefits.

Figure 4:
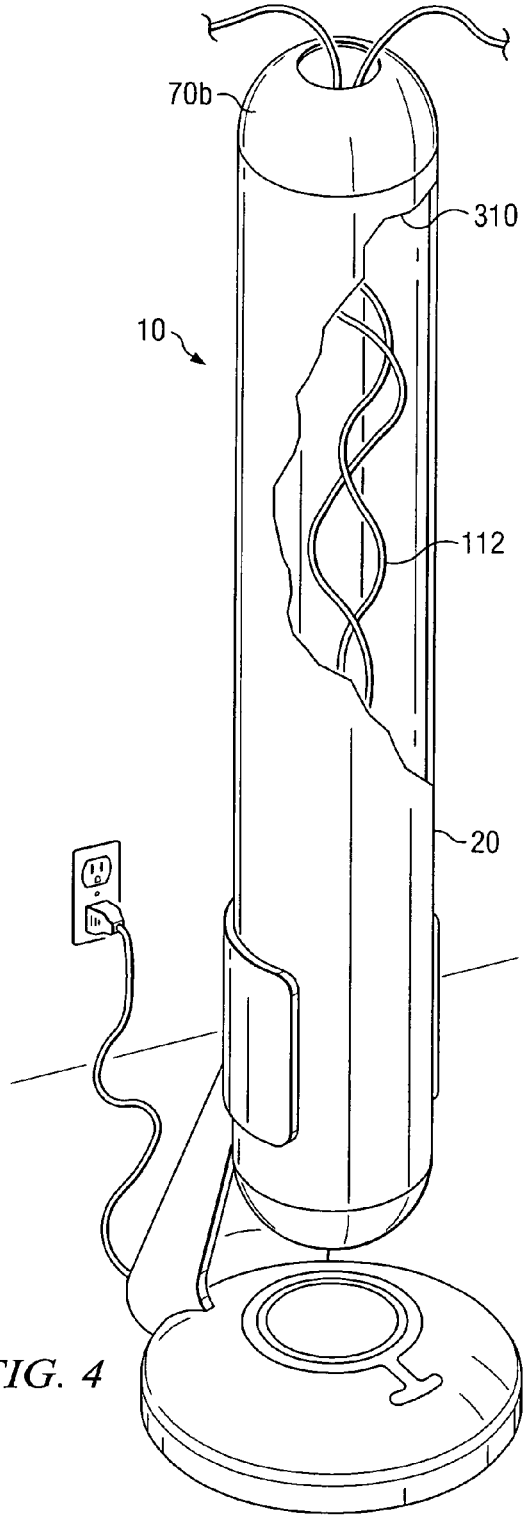
FIG. 4 illustrates a cutaway view of the cord management device while device cords are stored in the cord management device.

FIG. 4 represents a partial cutaway view of cord management device 10. The portion of cord management device 10 located above cutaway line 310 is shown as a cross-sectional view of the interior of cord management device 10, while the portion below cutaway line 310 is shown as a front view of the exterior of cord management device 10. FIG. 4 illustrates cord management device 10 during operation. Device plugs 114 are plugged into outlets 40 and brick outlets 45, and device cords 112 have been inserted into cavity 80 and threaded through notches 105. Although device cords 112 in FIG. 4 are shown as threaded through notches 105, in a particular embodiment of cord management device 10, device cords 112 may instead rest between frame 20 and cavity cover 70 after being inserted in cavity 80, keeping a portion of cavity cover 70 displaced from its original position. As another alternative, cavity cover 70 may be shaped to allow cavity cover 70 to return to its original position even while device cord is extending from cavity 80. For example, a portion of cavity cover 70 may include a hole sized and/or shaped to fit device cord 112, allowing cavity cover 70 to return to its original position when device cord 112 is aligned with the hole.

In the illustrated embodiment, frame 20 possess a substantially cylindrical shape. The cylindrical shape limits the number of corners frame 20 possesses. Because corners can trap cords inserted into cavity 80 and inhibit the free movement of cords within cavity 80, corners may prevent device cords 112 from repositioning as new device cords 112 are added to cavity, resulting in optimal use of the storage space provided by cavity 80. Thus, the substantially cylindrical shape of frame 20 provides benefits in optimizing use of the storage space offered by cord management device 10.

Additionally, the shape of frame 20, top opening 60*b*, slitted cap 70*b*, and/or other components of cord management device 10 may cause device cords 112 to bunch during or after being deposited in cavity 80. This bunching may result in twisting or braiding of device cords 112, as shown in FIG. 4. This braiding may prevent individual device cords 112 from straying from the collection of other device cords 112 and, as a result, provide additional organizational benefits.

Figure 5A:
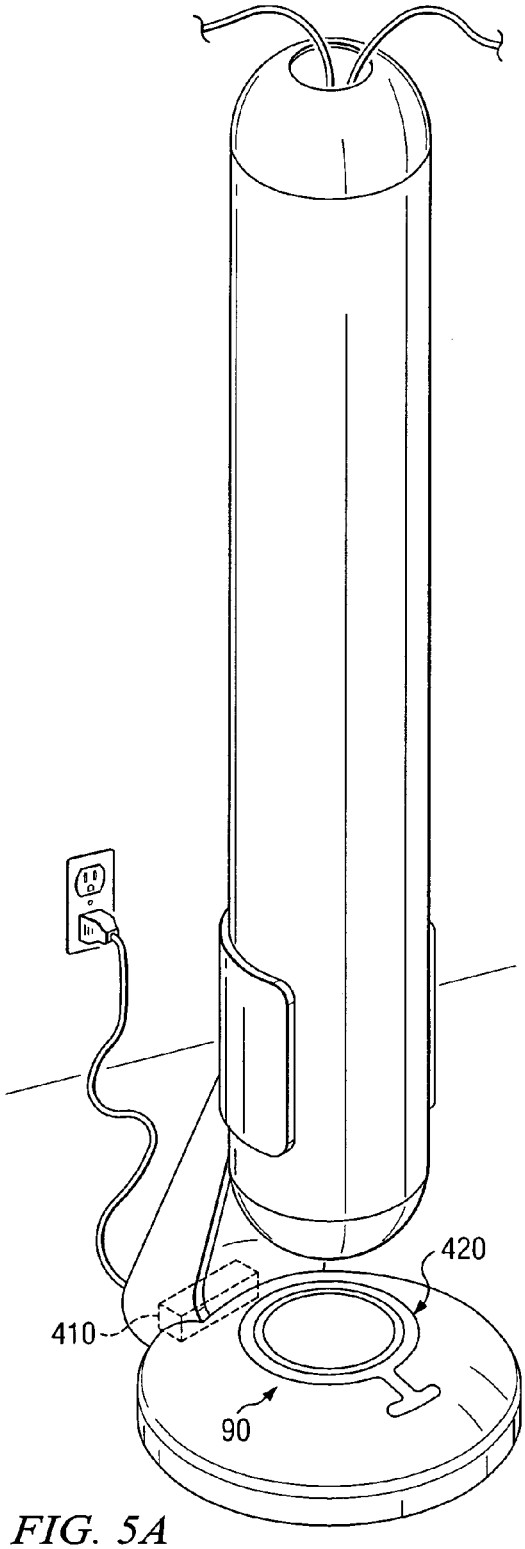
FIGS. 5A–5E illustrate operation of a status indicator according to a particular embodiment.

FIGS. 5A–5E illustrate operation of a particular embodiment of status indicator 90 in greater detail. As indicated above, status indicator 90 displays information about electricity flow to outlets 40 and brick outlets 45. FIG. 5A illustrates the location of status indicator 90 on a particular embodiment of cord management device 10. Although FIG. 5A illustrates a status indicator 4A positioned in a particular location on cord management device 10, status indicator 90 may be located in any appropriate position on cord management device 10. Additionally, although the description below focuses on a particular embodiment of status indicator 90 that detects "OFF", "PROTECTED", and "FAULT" statuses of cord management device 10, cord management device 10 may include a status indicator 90 configured to detect any appropriate status or statuses of cord management device 10, based on any appropriate characteristic, property, or attribute of cord management device 10, electronic devices coupled to cord management device 10, external power supply 120, or any other component associated with cord management device 10.

Figure 5B:
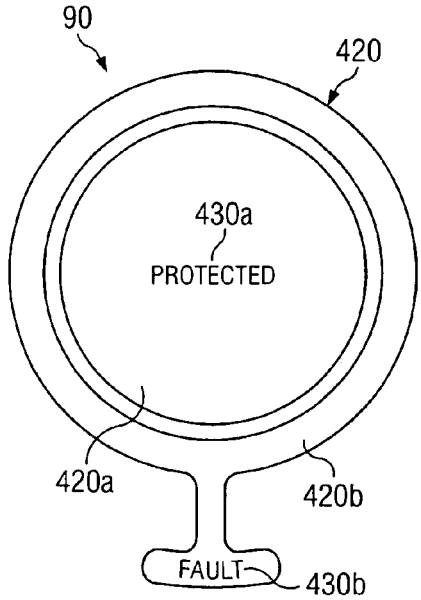

FIGS. 5A and 5B illustrate a particular embodiment of status indicator 90 that includes a status detector 410, a painted surface 420, and one or more textual indicators 430. Status detector 410 detects a status or a change in status of cord management device 10 and controls painted surface 420 and other appropriate components to convey information pertaining to the status to users. FIG. 5A shows a side view of cord management device 10, while FIG. 5B shows a top-down view of a surface of cord management device 10 that includes painted surface 420 and textual indicators 430.

Status detector 410 detects a status of cord management device 10 and controls other components of status indicator 90 to convey this status to users. For purposes of this description, detecting a "status" of cord management device 10 may include detecting a status, detecting a change in the status, or detecting other characteristics, properties, or attributes of cord management device 10 or other devices associated with cord management device 10 to determine the status. As noted above, although FIGS. 5A–5E illustrate operation of a particular embodiment of status detector 410 configured to detect a particular status of cord management device 10, particular embodiments of cord management device 10 may include a status detector 410 configured to detect any suitable status.

In the illustrated embodiment, status detector 410 is capable of detecting whether cord management device 10 is currently supplying electricity to outlets 40 and brick outlets 45 and whether an electric surge has caused cord management device 10 to terminate the flow of electricity to outlets 40 and brick outlets 45. In particular, status detector 410 detects an "OFF" state when switch 95 is in an "OFF" position or cord management device 10 is disconnected form external power supply 120. Status detector 410 detects a "PROTECTED" state when switch 95 is in an "ON" position and electricity is flowing to outlets 40 and brick outlets 45. Additionally, status detector 410 detects a "FAULT" state when switch 95 is in an "ON" position but cord management device 10 has terminated the flow of electricity to outlets 40 or brick outlets 45 as a result of an electric surge or other appropriate event.

Painted surface 420 represents an appropriately positioned surface of cord management device 10 to which luminescent paint or another suitable covering has been applied that is capable of producing light in response to an electric current applied to the covering. Painted surface 420 may receive electric current from status detector 410 or other appropriate components of cord management device 10 in response to status detector 410 detecting a change in the status of cord management device 10.

In the illustrated embodiment, painted surface includes a first portion 420*a* and a second portion 420*b*. First portion 420*a* and second portion 420*b* may include luminescent paint that produce light of different colors. As a result, cord management device 10 may be capable of indicating the status of cord management device 10 by generating light of a particular color. For example, in a particular embodiment, the luminescent paint of first portion 420*a* may generate indigo light when electric current is applied to first portion 420*a*. Similarly, the luminescent paint of second portion 420*b* may generate red light when electric current is applied to second portion 420*b*. Status indicator 90 may be configured to apply an electric current to the first portion 420*a*, and thus generate an indigo light, when cord management device 10 is in the "PROTECTED" state. Status indicator 90 may be configured to apply an electric current to the second position 420*b*, and thus generate a red light, when cord management device 10 is in the "FAULT" state.

Textual indicators 430 represent text located on cord management device 10 that may be illuminated by the luminescent paint of painted surface 410. The text may include letters, symbols, numbers, or text in any other suitable form to convey the relevant state of cord management device 10. In particular embodiments of cord management device 10, status indicator 90 may indicate the status of cord management device 10 by illuminating or terminating illumination of one or more of textual indicators 430. For example, in the illustrated embodiment, cord management device 10 illuminates textual indicator 430*a*, which includes the text "PROTECTED", to indicate the "PROTECTED" status of cord management device 10 and illuminates textual indicator 430*b*, which includes the text "FAULT", to indicate a "FAULT" status of cord management device 10. In a particular embodiment, textual indicators 430 may comprise luminescent paint and may represent some or all of painted surface 410. Additionally, textual indicators 430 may be positioned on top of painted surface 410 so that painted surface 410 creates an illuminated background for textual indicators 430 when activated, making textual indicators easier to read or distinguish. Alternatively, textual indicators 430 may be positioned near and/or adjacent to painted surface 410 so that light generated by painted surface 410 illuminates textual indicators 430 indirectly.

In operation in the illustrated embodiment, status detector 410 detects a status of cord management device 10, as described above. Status detector 410 conveys the detected status by applying an electric current to or removing an electric current to first portion 320*a* and/or second portion 320*b* to illuminate a particular portion of the luminescent paint in painted surface 320. Furthermore, based on the position of textual indicators 330, the light generated by first portion 320*a* or second portion 320*b* will illuminate the particular textual indicator 320 associated with the same state as that portion of painted surface 320.

Figure 5C:
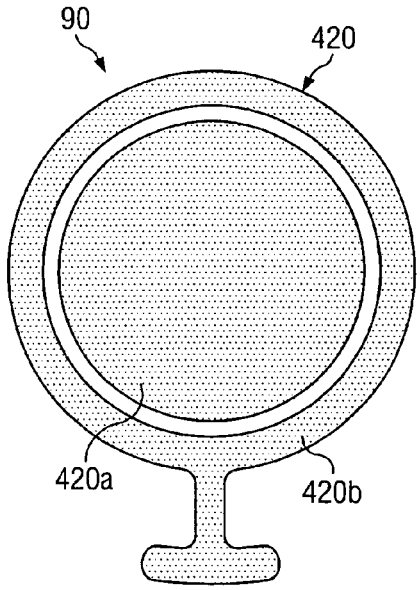

FIG. 5C illustrates, in particular, operation of status indicator 90 while cord management device 10 is in an "OFF" state. In the illustrated embodiment, status detector 410 detects the "OFF" status of cord management device 10. As a result, status detector 410 does not apply an electric current to either first portion 320*a* or second portion 320*b* or, if already applying the current to first portion 320*a* or second portion 320*b*, status detector 410 terminates the application of current to the relevant portion. As a result, neither first portion 320*a* nor second portion 320*b* generates light when the illustrated embodiment of cord management device 10 is in the "OFF" state. This is represented in FIG. 5B by the shaded first portion 320*a* and second portion 320*b*.

Figure 5D:
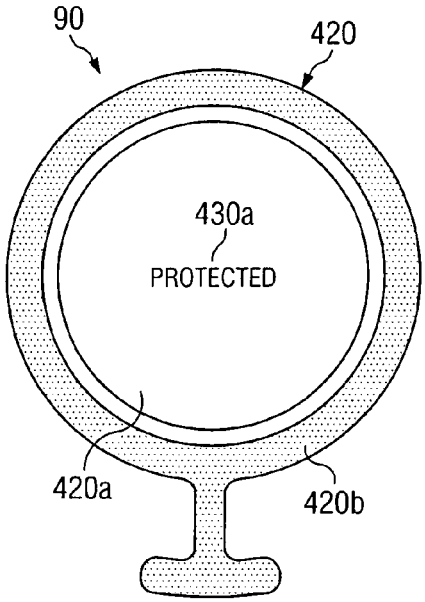

FIG. 5D illustrates operation of status indicator 90, according to a particular embodiment, while cord management device 10 is in a "PROTECTED" state. In the illustrated embodiment, status detector 410 detects the "PROTECTED" status of cord management device 10 and, as a result, applies an electric current to first portion 320*a*. In response to the electric current, the luminescent paint in first portion 320*a* generates indigo light. Furthermore, the light generated by first portion 320*a* illuminates textual indicator 320*a* which bears the word "ON." If status detector 410 is already applying a current to second portion 320*b*, status detector 410 may terminate application of the current to second portion 320*b*. This is shown in FIG. 5C by the unshaded first portion 320*a* and the shaded second portion 320*b*.

Figure 5E:
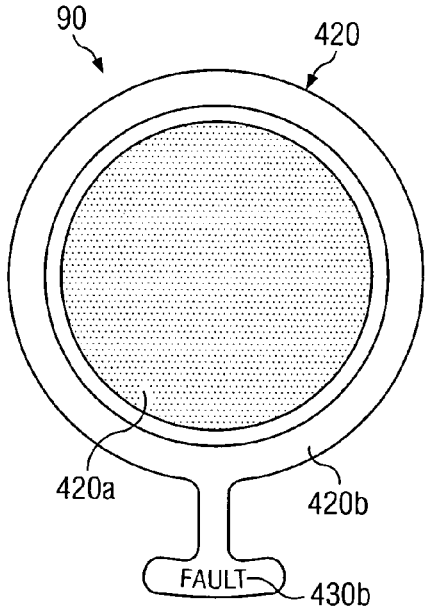

FIG. 5E illustrates operation of status indicator 90, according to a particular embodiment, while cord management device 10 is in a "FAULT" state. In the illustrated embodiment, status detector 410 detects the "FAULT" status of cord management device 10 and, as a result, applies an electric current to second portion 320*b*. In response to the electric current, the luminescent paint in second portion 320*b* generates red light. Furthermore, the light generated by second portion 320*b* illuminates textual indicator 320*b*, which bears the word "FAULT." If status detector 410 is already applying a current to first portion 320*a*, status detector 410 may terminate application of the current to first portion 320*a*. This is shown in FIG. 5C by the shaded first portion 320*a* and the unshaded second portion 320*b*.

As a result, status indicator 90 offers an improved technique for conveying information regarding a particular status of cord management device 10. By providing clear visual indications of the current state, particular embodiments of cord management device 10 may provide improved ease-of-use. Additionally, particular embodiments may provide increased security against unexpected damage from electrical surges.

Figure 6A:
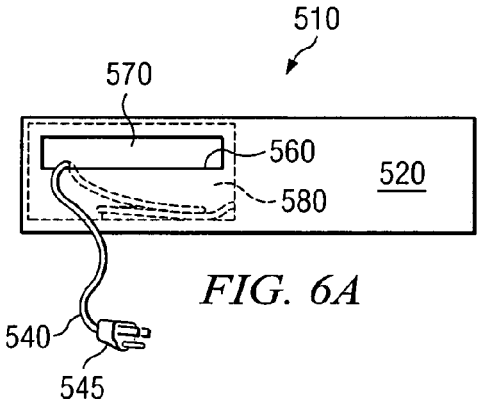
FIGS. 6A–6B illustrate an alternative embodiment of the cord management device.
Figure 6B:
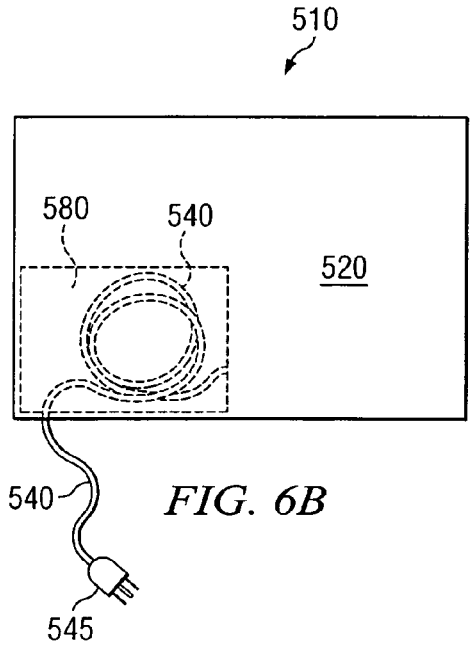

FIGS. 6A and 6B represent a front and top view, respectively, of an alternative embodiment of the cord management device, cord management device 510. In this alternative embodiment, cord management device 10 may represent any device, component, or, apparatus that utilizes electricity or receives signals provided by an external source. In this embodiment, frame 520 represents a housing of the electronic device that encloses a cavity 580. Cord management device 510 additionally includes a cavity opening 560 and a cavity cover 570 similar to those described above.

Cavity 580 of frame 420 is capable of storing a cord 540 of cord management device 510. One end of cord 540 may couple to cord management device 10 within the interior of frame 20, as shown in FIG. 6B. The other end of cord 540 may terminate in a plug 545 capable of connecting to an external power supply and providing electricity from the external power supply to cord management device 510. For example, cord management device 510 may represent a video cassette recorder (VCR) and cord 540 may represent the power cord of that VCR. Cord 540 may couple to the VCR through a surface of cavity 580 as shown in FIG. 6B and supply VCR with electricity. Excess lengths of cord 540 may be stored in cavity 580.

As a result, under this alternative embodiment, a device may serve as its own cord management device. Therefore, both electronic devices 110 and cord management device 510 shown in FIG. 1 may, in fact, represent cord management devices similar to cord management devices 510. More specifically, one or more electronic devices 110 of FIG. 1 may store portions of device cords 112 within a cavity 580 of that electronic device 110, and cord management device 10 may store portions of primary cord 55 in cavity 80.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims. As one example, although the above description focuses, for purposes of illustration, on an embodiment of cord management device 10 that serves as a power strip for electronic devices 110, cord management device 10 may additionally, or alternatively, provide data or other signals to electronic devices 110. For example, instead of representing a power strip, cord management device 10 may represent an Ethernet hub configured to allow the user to store Ethernet cables within cavity 80. In such an embodiment, device cords 112 may represent Ethernet cables, while device plugs 114, may represent plugs appropriate for connecting such Ethernet cables to a data port.

What is claimed is:

1. A device for providing electricity comprising:

a substantially cylindrical frame;

an outlet operable to provide electricity to electric devices plugged into the outlet;

a plug operable to provide electric power to the outlet from an external power source;

a cavity formed within the frame and operable to store a cord;

a slitted cap, wherein at least a portion of the slitted cap is operable to:

allow access to the cavity through a top opening in the substantially cylindrical frame when a force is applied to the slitted cap; and cover the top opening when the force is removed from the slitted cap.

2. The device of claim 1, wherein the slitted cap comprises an elastomeric substance, and wherein at least a portion of the slitted cap is further operable to allow access by bending when the force is applied to the cavity cover, and wherein at least a portion of the slitted cap is further operable to cover the cavity by returning to an original shape when the force is removed from the cavity cover.

3. The device of claim 1, wherein at least a portion of the slitted cap is operable to allow access to the cavity by allowing a cord to be pressed into the cavity.

4. The device of claim 1, wherein the cavity forms a substantially cylindrical portion of an interior of the frame.

5. The device of claim 1, further comprising:

a lateral cover, wherein the lateral cover is operable to:

allow access to the cavity through a lateral opening when a force is applied to the lateral cover; and cover the lateral opening when the force is removed from the lateral cover.

6. The device of claim 5, wherein the lateral opening is operable to receive a first end of a cord that is plugged into the outlet and the top opening is operable to accept a second end of the cord without the slitted cap being removed or the plug being unplugged from the outlet.

7. The device of claim 6, wherein the top opening is further operable to accept the second end receiving the second end through a slit of the slitted cap.

8. The device of claim 1, further comprising a plurality of outlets, each of the outlets operable to provide electricity to electronic devices plugged into the outlet.

9. The device of claim 8, wherein the plurality of outlets comprise a plurality of outlets and a brick outlet, and wherein the brick outlet is placed below substantially all of the outlets on the device when the device is in an operational position.

10. The device of claim 1, further comprising a nightlight.

11. The device of claim 1, wherein the outlet is surge-protected.

12. The device of claim 11, further comprising a status indicator operable to:

indicate a first state when the outlet is not powered by the external power source; and indicate a second state when the outlet is powered.

13. The device of claim 12, wherein the status indicator is further operable to indicate a third state when the outlet is not surge-protected.

14. The device of claim 12, wherein the status indicator comprises a night light.

15. The device of claim 12, wherein the status indicator comprises luminescent paint and the status indicator is operable to indicate the second state by illuminating the luminescent paint.

16. The device of claim 15, wherein the luminescent paint forms text indicating that the device is powered.

17. The device of claim 1, further comprising a cord coupling the plug to the device and wherein at least a portion of the cord is operable to be stored in the cavity.

18. The device of claim 1, further comprising a base operable to support the frame so that a lengthwise dimension of the frame extends vertically.

19. The device of claim 1, further comprising a safety tab operable to automatically cover the outlet when a plug is removed from the outlet.

20. The device of claim 1, further comprising a safety tab operable to:

allow access to the outlet when a force is applied to the safety tab; and cover the outlet when the force is removed from the safety tab if no plug is plugged into the outlet.

21. The device of claim 20, wherein:

the safety tab comprises an elastomeric substance;

the safety tab is further operable to allow access to the outlet by bending when the force is applied and wherein the safety tab is further operable to cover the outlet by returning to an original shape when the force is removed from the safety tab.

22. The device of claim 1, further comprising a lateral opening, wherein the lateral opening includes a notch in the frame, wherein the notch is operable to secure a cord to the frame while the cord extends through the lateral opening.

23. The device of claim 22, wherein the lateral cover is further operable to return to an original shape while the cord is secured by the notch.

24. The device of claim 1, wherein the device further comprises a plurality of outlets, each outlet associated with one or more of a plurality of notches, wherein each notch is positioned substantially near the outlet associated with that notch and is operable to secure a cord to the frame while the cord extends from the cavity to the outlet associated with that notch.

25. A device for providing electricity comprising:

a frame;

a surge-protected outlet operable to provide electricity to electric devices plugged into the surge-protected outlet;

a plug operable to provide electric power to the surge-protected outlet from an external power source;

a cavity formed within the frame and operable to store a cord;

a cavity cover, wherein the cavity cover is operable to:

allow access to the cavity through a cavity opening when a force is applied to the cavity cover; and cover a portion of the cavity opening when the force is removed from the cavity cover; and a status indicator comprising luminescent paint that indicates whether the device is powered, wherein the status indicator is operable to:

indicate a first state when the outlet is not powered by the external power source; and indicate a second state when the outlet is powered;

and wherein the status indicator is operable to indicate at least one of the first state and the second state by illuminating the luminescent paint.

26. The device of claim 25, wherein the cavity cover comprises an elastomeric substance, and wherein the cavity cover is further operable to allow access by bending when the force is applied to the cavity cover, and wherein the cavity cover is further operable to cover the cavity by returning to an original shape when the force is removed from the cavity cover.

27. The device of claim 25, wherein the cavity cover is operable to allow access to the cavity by allowing a cord to be pressed into the cavity.

28. The device of claim 25, wherein:

the frame comprises a substantially cylindrical frame; and the cavity forms a substantially cylindrical portion of an interior of the frame.

29. The device of claim 25, further comprising a plurality of outlets, each of the outlets operable to provide electricity to electronic devices plugged into the outlet.

30. The device of claim 29, wherein the plurality of outlets comprise a plurality of outlets and a brick outlet, and wherein the brick outlet is placed below substantially all of the plurality of outlets on the device when the device is in an operational position.

31. The device of claim 25, further comprising a night-light.

32. The device of claim 25, wherein the night light comprises at least a portion of the status indicator.

33. The device of claim 25, wherein the status indicator is further operable to indicate a third state when the outlet is not surge-protected.

34. The device of claim 25, further comprising a primary cord coupling the plug to the device, wherein at least a portion of the primary cord is operable to be stored in the cavity.

35. The device of claim 25, further comprising a base operable to support the frame so that a lengthwise dimension of the frame extends vertically.

36. The device of claim 25, further comprising a safety tab operable to automatically cover the outlet when a plug is removed from the outlet.

37. The device of claim 25, further comprising a safety tab operable to:

allow access to the outlet when a force is applied to the safety tab; and cover the outlet when the force is removed from the safety tab if no plug is plugged into the outlet.

38. The device of claim 37, wherein:

the safety tab comprises an elastomeric substance;

the safety tab is further operable to allow access to the outlet by bending when the force is applied and wherein the safety tab is further operable to cover the outlet by returning to an original shape when the force is removed from the safety tab.

39. The device of claim 25, wherein the cavity opening further comprises a notch in the frame, wherein the notch is operable to secure a cord to the frame while the cord extends through the cavity opening.

40. The device of claim 39, wherein the cavity cover is further operable to return to an original shape while the cord is secured by the notch.

41. The device of claim 25, wherein the device further comprises a plurality of outlets, each outlet associated with one or more of a plurality of notches, wherein each notch is positioned substantially near the outlet associated with that notch and is operable to secure a cord to the frame while the cord extends between the cavity and the outlet associated with that notch.

* * * * *